United States Patent [19]

Sprong

[11] 4,042,155

[45] Aug. 16, 1977

[54] FABRIC PLEATER GUIDE INCLUDING A PLEAT FORMER

[76] Inventor: Edmund Jay Sprong, 38 Lockwood Lane, Riverside, Conn. 06878

[21] Appl. No.: 687,357

[22] Filed: May 17, 1976

Related U.S. Application Data

[63] Continuation-in-part of Ser. No. 638,530, Dec. 8, 1975, abandoned.

[51] Int. Cl.[2] ..... A41H 43/00; D05B 35/08

[52] U.S. Cl. ..... 223/34

[58] Field of Search ..... 223/28–35; 33/174 G, 174 B, 1 B, 190, 192, 197, 191, 168 R, 178 B, 111, 137 R, 137 L, 176, 179; 160/348; 112/427, 136, 141, 144–146, 147

[56] References Cited

U.S. PATENT DOCUMENTS

| | | | |
|---|---|---|---|
| 2,805,007 | 9/1957 | Aschbacher | 223/34 |
| 3,029,004 | 4/1962 | Schiavone | 223/34 |
| 3,133,681 | 5/1964 | Shee | 223/34 |
| 3,643,336 | 2/1972 | Henry | 33/174 G |
| 3,667,677 | 5/1972 | Sprong | 223/34 |
| 3,712,520 | 1/1973 | Vipond | 223/34 |

*Primary Examiner*—G. V. Larkin
*Attorney, Agent, or Firm*—Alfred E. Miller

[57] ABSTRACT

A simplified adjustable fabric pleater guide particularly for use in spacing and forming pinch pleats in draperies. A scale is provided on a measuring stick which may be metrically calibrated, as well as calibrated in inches, while an index is provided on the adjustable fabric guide for rapidly and accurately setting the required primer pleats longitudinally on the fabric. A pinch pleat former is utilized to quickly and accurately divide the primary pleats into pinch pleats.

12 Claims, 16 Drawing Figures

FABRIC PLEATER GUIDE INCLUDING A PLEAT FORMER

This application is a continuation in part of my copending application Ser. No. 638,530 filed Dec. 8, 1975, now abandoned.

BACKGROUND OF THE INVENTION

Any person, skilled or unskilled, finds it difficult to establish the correct location of the required pleats on a length of fabric without the use of some type of mechanical aid. This is so because for an individual to correctly measure for pleated drapes, the total width of each of the drapes is measured and the number of pleats desired is calculated. Then, the width of each pleat is figured, and the spacing between adjacent pleats is determined. This procedure is often inaccurate whereby several size adjustments are often made in order to achieve the proper pleat width and spacing between the pleats. Moreover, even after corrections have been made it is not always certain that the calculation made is precise and that the correct pleated drape measurements will be made.

The mechanical aids previously proposed to assist the drapery maker were complex and cumbersome. Applicant's fabric pleater guide as described in his U.S. Pat. No. 3,667,677 was an improvement in that it did succeed in simplifying the drapery making procedure, however, the present invention has reduced the mechanical drapery making aid to its simplest form and yet this device operates effectively and accurately.

SUMMARY OF THE INVENTION

The present invention relates to a portable lightweight fabric pleater guide which is so simple to operate that it can be used by both the unskilled beginner and skilled professional drapery maker with successful results.

It is an object of the present invention to provide a drapery pleat loop spacer that will produce accurately reproducible primary pleat loops of uniform size, and also provides for a selective adjustment for the various spacings between the primary pleat loops.

Another object of the present invention is to provide the drapery maker with the option of positioning the primary pleat loops by either stapling, marking or pinning.

An object of the present invention is to provide a drapery pleat loop spacer with a fixed finger, an elongated base, an adjustable relatively broad finger, and a stapler device to effect the positioning of the primary pleat loops.

It is a further object of the present invention to provide a drapery pleat loop spacer with a fixed marking finger on an elongated calibrated base, and a separately assembled adjustable broad finger.

Another object of the present invention is to provide the drapery maker with an option of positioning the primary pleats by marking, pinning or stapling.

The pleat loop spacer constructed in accordance with the teachings of my invention is portable and can be provided with a metrically calibrated scale on its base member so that the pleat loop spacings may be quickly and easily determined.

It is still another object of the present invention to provide a pleater device for draperies in which the material panel can be spread out flat on a flat surface and does not have to be handled by the operator while positioning pleats. Thus, the panel can be completely finished and the pleats positioned thereafter, starting from either the right or the left hand side of the panel. It should be evident that it is not necessary with my pleater device to fold the fabric in half and the first pleat positioned at the centerfold thereof, as was the procedure in previous fabric pleater guide devices.

A further object of the present invention is to provide a pinch pleat former which when inserted in the primary pleat loop and centered over the seam of the loop automatically and precisely divides the loop into three equal folds forming what is commonly known as a pinch pleat.

Another object of the present invention is to provide a drapery pleat spacer and former which can be inexpensively manufactured out of plastic, metal or hard board stampings and which can be used effectively by the beginner and professional drapery maker.

In order that the invention will be more clearly understood, it will now be disclosed in greater detail with reference to the accompanying drawings, in which:

FIG. 1 is a front elevational view of the fabric pleater guide device constructed in accordance with the teachings of my invention.

FIG. 1*a* is an exploded side view of the device shown in FIG. 1

Figure 4A:
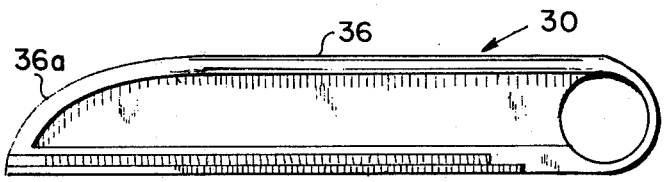
Figure 4:
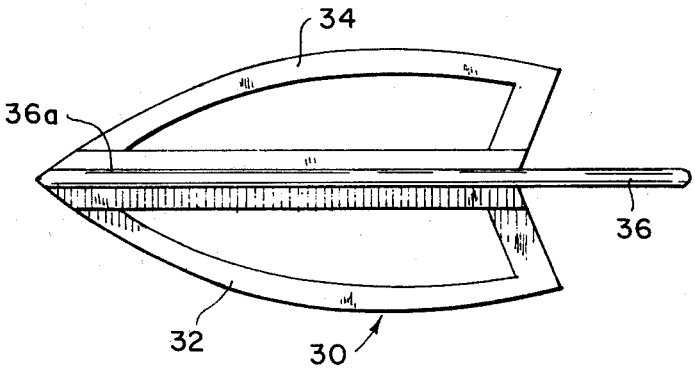
Figure 4B:
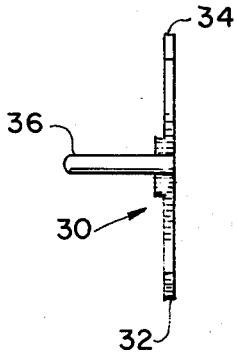

FIGS. 4, 4*a* and 4*b* are top plan, side view and end view of a pleat former that is utilized with the present device for making pinch pleats in drapes.

Figure 5:
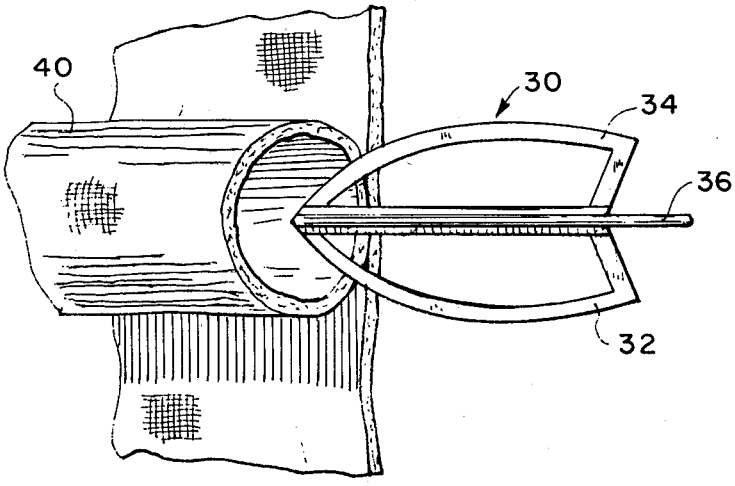

FIG. 5 is a perspective view of the pleat former shown in FIGS. 4, 4*a* and 4*b* prior to its insertion in a drapery primary loop.

Figure 6:
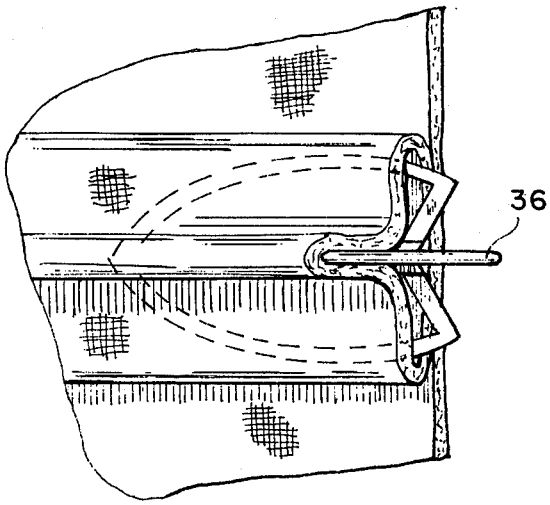

FIG. 6 is a perspective view of the pleat former inserted within the drapery loop and positioned for forming a precise pinch pleat.

Figure 7:
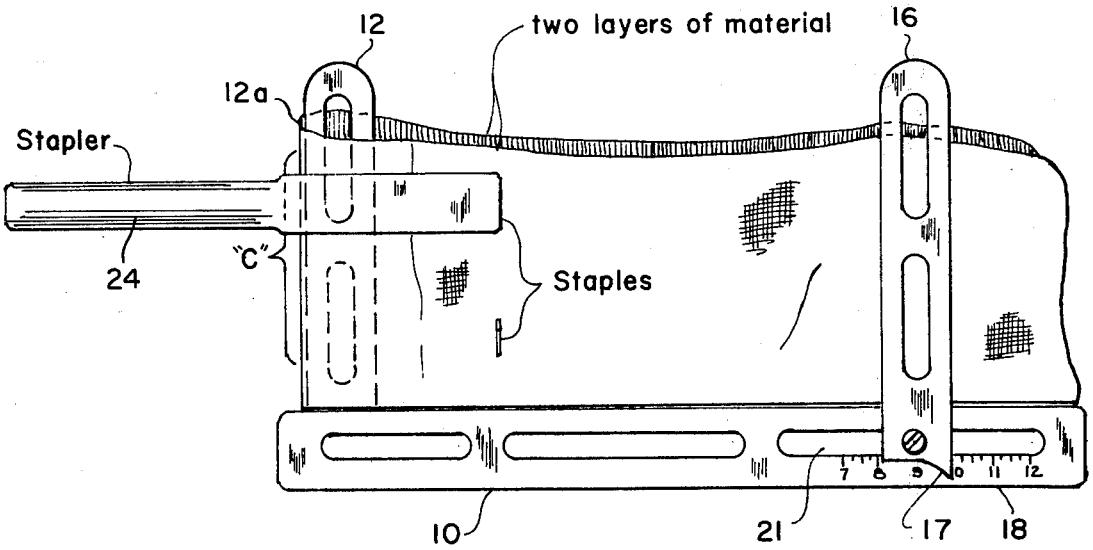

FIG. 7 is an alternate embodiment of the present invention in which only one fixed and one movable leg is shown, and which incorporates a long throw stapler for determining the precise locations of the drapery pleats.

Figure 8:
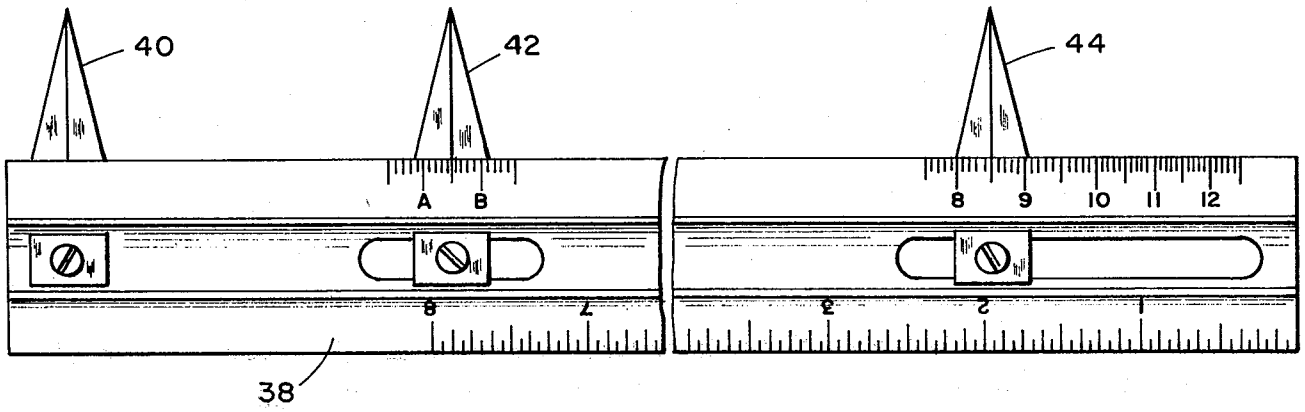

FIG. 8 is a front elevational view of another embodiment of my present invention showing a fabric pleater guide having three fingers in which the end finger is in a fixed position.

Figure 9:
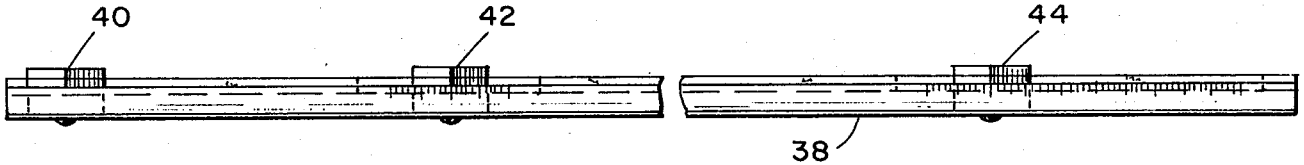

FIG. 9 is a top plan view of the fabric pleater guide shown in FIG. 8.

Figure 10:
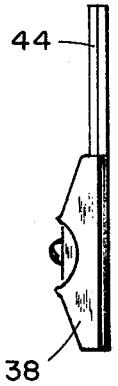

FIG. 10 is a side elevational view of the fabric pleater guide shown in FIG. 8, and FIGS. 11–13 are diagrammatic views showing the mode of operation of the fabric pleater guide illustrated in FIGS. 8–10.

DESCRIPTION OF THE PREFERRED EMBODIMENTS

Figure 1:
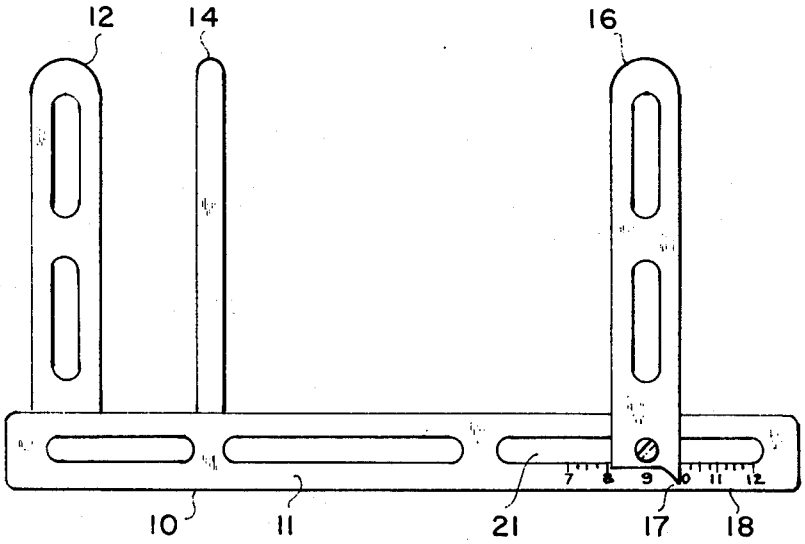
Figure 1A:
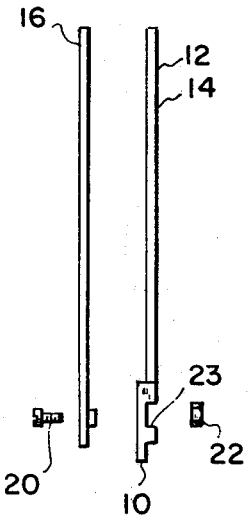

The drapery loop spacer device is shown generally by the reference numeral 10 and constitutes a base member 11 having generally perpendicular fingers, such as a broad fixed finger 12 and a relatively narrow fixed finger 14. The base 11 is provided with a measuring scale which may be in the metric system, and and adjustable broad finger 16 having an index pointer 17. As seen in FIG. 1*a* the drapery loop spacer device is assembled in a tongue and groove arrangement in which a bolt 20 is inserted through the slot 21 and screw connected to the restraining nut 22 that is housed in the groove 23 at the surface of the base 11 behind the calibrated area 18. It should be observed that the bolt 20 can be moved along the slot 21 to a selected position so that the finger 16 is adjustable laterally in order to position the same for the correct drapery pleat loop spacing.

Figure 2:
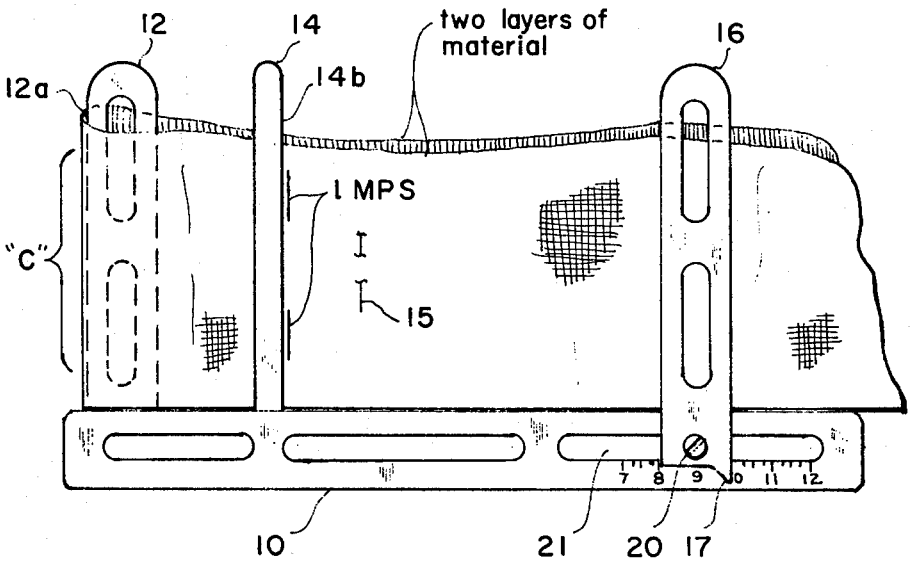
FIG. 2 is a front elevational view of the device which is similar to FIG. 1, but shown as used with drapery material in a first step of the procedure.

In using the drapery loop spacer device 10, the number of pleat loops in a given length of fabric is determined and the adjustable finger 16 is adjusted and set for the required distance between the pleat loops. Then, in order to prepare the heading of the drapery panel, the material is folded in half on the wrong side to establish the center C. Thereafter in order to begin forming and positioning pleat loops the material is held with the stiffening edge toward the drapery maker with the center fold on her left, and the remainder of the material flowing to the right. As shown in FIG. 2 the pleat loop spacer 10 is held with the fingers 12, 14, and 16 pointing away from the operator. The broad finger 12 is then slipped into the center fold of the material C with the latter positioned along the finger edge 12*a.* Thereafter, both layers of material are firmly pulled to the right under fingers 14 and 16 as seen in FIG. 2. A pin 15 is now inserted through both layers of material about 1½ inches to the right of the marking finger 14 to thereby hold both layers taut. At this point the precise position of the pleat loop can be determined by three different methods as follows:

1. Marking by means of visible marking means as close as possible to the edge 14*b* of the finger 14 referred to by the designation MPS. Thus, when the finger 14 is slipped out of the fabric loop, a plurality of straight pins are inserted on the marks as well as through both layers of material.

2. Pinning through both layers of material at locations as close as possible to the edge 14*b* of the finger 14.

3. Stapling by means of a long throw stapler, preferably having an adjustable throat. This particular arrangement is shown in FIG. 7.

Upon using one of the above three methods the first or center pleat loop is established and the holding pin 15 shown in FIG. 2 can be removed.

Figure 3:
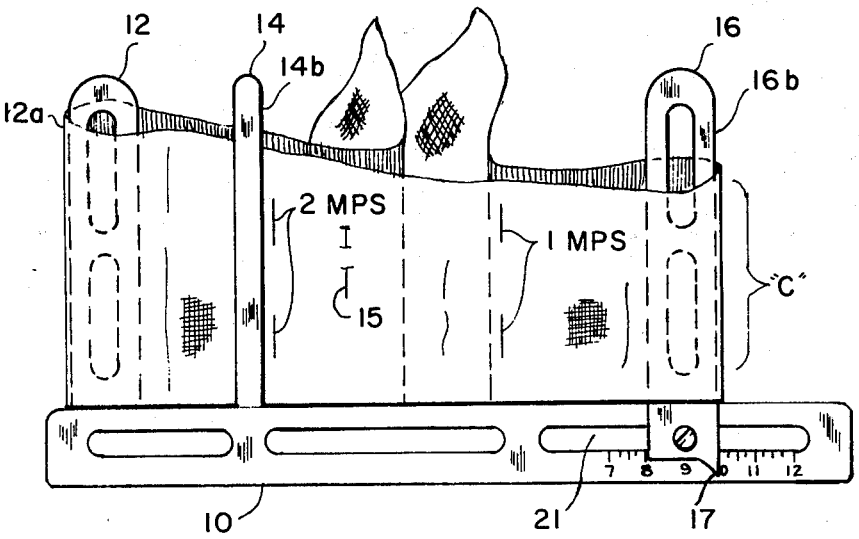
FIG. 3 is a front elevational view of the device similar to FIG. 2 but with a further step in the procedure of making drapes.

Referring to FIG. 3, the next step in the present method is to slip the adjustable finger 16 into the first or center loop C, with the center C being positioned along the finger edge 16*b,* and the top single layer of material being drawn to the left. Thereafter, the procedure is to position and form pleat loops to the left of the center loop C. In order to accomplish this, the single layer of material is pulled to the left and under the marking finger 14, over and around fixed broad finger 12 and edge 12a, and to the right under finger 14 toward the adjustable broad finger 16. When this is achieved the holding pin 15 is inserted through both layers of material about 1½ inches to the right of finger 14, as seen in FIG. 3. As described above, the operator has the option of positioning and forming the second pleat loop by either marking, pinning or stapling, as was performed in the formation of first or center loop C. The foregoing process is repeated until all the pleat loops to the left of the center are completed.

In order to position and form the pleat loops to the right of the center loop the pleat loop spacer 10 is turned over and the adjustable broad finger 16 now appears on the left. The finger 16 is inserted into the center loop with the material center C now positioned along the left edge 16*b* of finger 16. The material is pulled in a firm manner to the right under marking finger 14, over and around the fixed broad finger 12 and edge 12*a,* and thereafter to the left under finger 14 toward finger 16. Then a holding pin 15 is inserted about 1½ inches to the left of the marking finger 14 through both layers of material. Furthermore, in order to finish the position and formation of the first pleat to the right of the center loop a selection can be made from the three methods of positioning and formation, as set forth above. Furthermore, the remainder of the pleat loops to the right of the center loop can be completed by following the procedure explained in detail hereinabove.

Referring to FIGS. 4–6 of the drawings, the pleat former 30 is shown forming a pinch pleat in the loop 40.

The pinch pleat former 30 is arrow-shaped and comprises three working edges 32, 34, and 36. It will be noted that the working edges 32 and 34 are identical in size and shape, while the other working surface 36 is positioned perpendicular to the working surfaces 32 and 34 respectively and is equi-distant from the edges 32 and 34. It will also be noted that the working edge 36 has a sloping front portion 36*a.*

In order to form a pinch pleat in a loop such as loop 40 of FIG. 5, the pleat loop former 30 is inserted within the loop 40 as shown in FIG. 5 with its flat base and edges 32 and 34 spreading the loop directly over the seam thereof, as seen in FIG. 6. Meanwhile, the sloping front portion 36*a* of the edge 36 easily slips into the loop and permits the loop former to enter the loop and to be positioned properly. Thereafter, the operator presses firmly along the raised sides of the edge 36, as shown in FIG. 6, while retaining a releasable hold on the raised center portion of the material and gently withdrawing the pleat former 30. Thereafter, both side folds are brought up to form the pinch pleat which is precisely formed.

It will be seen from FIG. 7 that the pleat loop spacer can be constituted of only two fingers on a base member. One of the fingers 12 is fixed while the other finger 16 is adjustable in a manner described hereinbefore. The pleat loops are formed as described hereinbefore, however a stapler 24 with a long throat which is precisely dimensioned is utilized. It is also within the spirit and scope of the present invention to make the throat of the stapler adjustable, however the stapler is so designed that it will staple the fabric at the precise location with the edge 12*a* serving as a guide or stop for the throat interior end. In this manner, precisely reproducible pleats can be formed rapidly and accurately, and it should be apparent that this can be done by unskilled workers as well as by professionals.

It should be observed that the present device overcomes the complexity of prior known devices and permits any person desiring to make drapes to quickly and accurately position pinch pleats in a drapery material of diverse widths. Moreover, the portable drapery pleat loop spacer may be fabricated out of plastic, metal or hard board stampings, and as such, can be economically manufactured.

Figure 11:
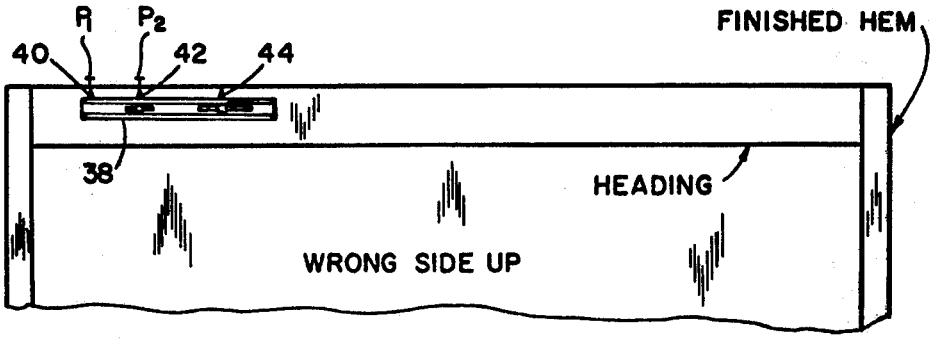
Figure 12:
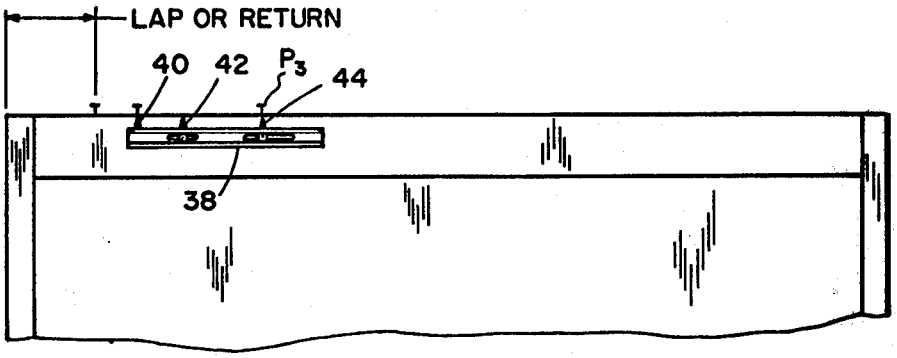
Figure 13:
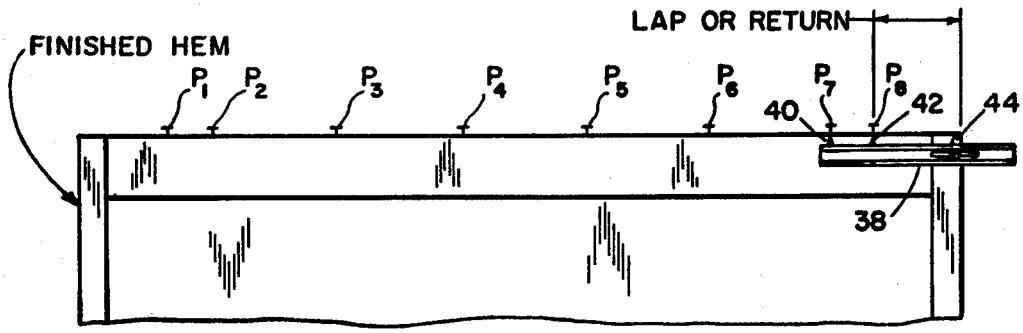

FIGS. 8–13 show an alternate embodiment of the present invention. It will be seen that the fabric pleater guide 38 is provided with a fixed finger 40, a finger 42 that is either adjustable or fixed, and an adjustable finger 44. The guide 38 is in the form of a straight edge having ruler markings, and as seen in FIGS. 11–13, is placed on the drapery panel on the wrong or opposite side thereof, for measuring the pleat locations. It should be pointed out that drapery headings currently being used employ stiffeners which make it very difficult, if not impossible, to repeatedly insert straight pins through the double thicknesses of the material. In order to avoid this serious problem, the present simplified device has been developed. The fabric material for the drapery panel is laid stationary and flat on a flat surface which may be a floor or a table, etc., and does not have to be folded or otherwise handled by the sewing operator while positioning the pleats. Furthermore, the panel can be initially completely finished, and the pleats positioned thereafter from either the left or the right side thereof.

Referring now more particularly to FIGS. 11–13, showing the actional mode of operation of the device, it should be noted that in preparing a drapery panel for the selected dimensions for a specific drapery rod size, the panel may be completely finished with side hems before positioning the pleats, return and lap. The prepared panel is then laid on a flat surface with the reverse or wrong side up, as seen in FIG. 11, and along the top edge of the heading a measurement is made from the left side of the prepared panel which is the distance required for the lap or the return. A pin P1 is inserted in the top edge of the heading marking this location. If the side hems have not been completed, then one half of the five inch allowance for the side hems must be added to the measurement before pin 1 is inserted. The fabric pleater guide is then positioned on the drapery panel with the fixed finger 40 directly under pin P1. With the guide in this position, a pin P2 is inserted in the top edge of the heading directly above the finger 42. This latter pin indicates the center of the first pleat loop.

The guide 38 is then moved to the right until the finger 40 is directly under the pin P2 which thus identifies the center of the first pleat loop. While maintaining the fabric pleater guide in the latter position a pin P3 is inserted in the top edge of the heading directly above the movable finger 44. Pin 3 then marks the center of the pleat 2. The above procedure is repeated until the centers of the required number of pleat loops for the panel are marked with pins along the top edge of the panel heading. The designation of the pleat loops is completed by positioning the fabric pleater guide with the fixed finger 40 under the pin P7 marking the center of the last pleat loop. It will be noted that the pin P8 is directly above the finger 42. The remaining material to the right of pin P8 conforms to the measurement of the lap or the return, plus the hem allowance, if not already finished.

In order to complete the pleat loop, the material is folded at right angles to the top edge of the fabric panel heading with the pin marking the center of the fold. The material is then sewed in order to finish the loop with the use of a former 30 shown in FIGS. 4–6 utilized in a manner described hereinbefore.

It will be observed that the fabric pleater guide set forth hereinabove is simple in construction, as well as easy to use by both experienced and inexperienced sewing operators.

What is claimed is:

1. A fabric pleater guide and pleat former for a pinch pleat comprising a base member having a calibrated measuring scale thereon, a fixed broad finger extending substantially perpendicular to said base member, an adjustable finger provided with an index part co-acting with said measuring scale whereby a length of fabric is doubled and the middle line thereof placed around an outer edge of one of said fingers and the cloth spread out, means for marking the placement of spaced primary pleat loops on said fabric and setting up the placement thereof, said pleat former being of such a size and dimension as to be freely inserted within said primary pleat loop and centered over the seam of the loop thereby dividing said loop into three substantially equal folds to thereby create said pinch pleat.

2. The combination as claimed in claim 1 wherein said pleat former is arrow-head shaped with guide edges, two of which are on a common plane, with the third edge being on a plane perpendicular thereto.

3. The combination as claimed in claim 2 wherein the third guide edge extends further rearwardly than the other two guide edges and functions as a finger grip.

4. The combination as claimed in claim 2 wherein said pleat former is fabricated of plastic.

5. The combination as claimed in claim 1 further comprising an additional fixed finger on said base member, said finger being spaced from said broad finger and being substantially narrower than the latter.

6. The combination as claimed in claim 1 wherein said base member and adjustable finger are separate elements, and bolt means for removably fixing said adjustable finger to said base member.

7. The combination as claimed in claim 1 further comprising a stapling device having a throat length that is predetermined by means of a throat stop whereby when the stapling device is placed around the fixed finger, with the stapling device throat stop engaging the outer edge of said fixed finger, the staples are inserted at the precise location for fixing each of said primary pleat loops.

8. The combination as claimed in claim 7 wherein said throat stop is adjustable for different spacing between primary pleat loops.

9. The combination as claimed in claim 6 wherein said fabric pleater guide is fabricated of plastic.

10. A fabric pleater guide and pleat former for creating pinch pleats on a drapery panel comprising a base member having a calibrated measuring scale thereon, three fingers extending substantially perpendicular to said base member in which at least one of said fingers is stationary, said stationary finger being one one end of said base member, said pleater guide being placed on the opposite side of said drapery panel that is laid out flat, the stationary finger being used to determine the location of one end of a first pinch pleat while the second middle finger identifies the center of said first pinch pleat to form a pleat loop, said pleater guide being moved laterally on said drapery panel until the stationary finger is directly under the center of said first pinch pleat while the third finger located at the other end of said base member identifies the center of a second pinch pleat, said pleat former being of such a size and dimension as to be freely inserted within each of said pleat loops thereby dividing said loop into three substantially equal folds thus creating a pinch pleat.

11. The combination as claimed in claim 10 wherein each of said fingers are in the form of an arrow head adapted to point to selected locations on said drapery panel in order to form a series of pinch pleats thereon.

12. The combination as claimed in claim 10 wherein said other end finger is adjustable.

* * * * *